US005535478A

United States Patent [19]

Thompson

[11] Patent Number: 5,535,478

[45] Date of Patent: Jul. 16, 1996

[54] CLEANING TOOL FOR REMOVING LINT FROM CLOTHES DRYERS

[76] Inventor: Gary A. Thompson, R.R. #2, Box 149C, Oxford, N.Y. 13830

[21] Appl. No.: 465,287

[22] Filed: Jun. 5, 1995

[51] Int. Cl.[6] ..... A47L 9/02

[52] U.S. Cl. ..... 15/401; 15/395; 15/419; 15/415.1

[58] Field of Search ..... 15/395, 401, 415.1, 15/414, 419, 420

[56] References Cited

U.S. PATENT DOCUMENTS

| | | | |
|---|---|---|---|
| 1,053,665 | 2/1913 | Spencer | 15/415.1 |
| 2,068,496 | 1/1937 | Linghammar | 15/415.1 |
| 2,800,678 | 7/1957 | Wessel | 15/395 |

FOREIGN PATENT DOCUMENTS

| | | | |
|---|---|---|---|
| 308257 | 10/1929 | United Kingdom | 15/395 |

*Primary Examiner*—David Scherbel
*Assistant Examiner*—Terrence R. Till
*Attorney, Agent, or Firm*—Salzman & Levy

[57] ABSTRACT

The present invention features a suction wand for use in cleaning lint from the lint-screen cavity of clothes dryers. This lint-catching tool is uniquely designed to provide a lint-loosening action in combination with a vacuum action. This dual action eliminates most of the drudgery associated with this particular task. The tool itself has four snap-together portions. The first portion of the tool consists of a collar that attaches to the corrugated conduit or hose of a vacuuming device. The collar has a flared, rounded end that receives a substantially flat, rounded, hollow, flexible, elongated cleaning tube. The peripheral edges of the cleaning tube are designed to be rounded so as to provide for ease of bending, which is a necessary flexibility for accessing hard-to-reach areas within the clothes-dryer cabinet. The third portion of the wand has an intermediate collar that links the elongated cleaning tube with its unique scraping-and-suction nozzle. This scraping-and-suction nozzle has novel inlet windows that are designed to capture the lint as the wand is thrust against lint-laden surfaces within the clothes cabinet. The inlet windows have scraping edges that form narrow inlet areas for the purpose of drawing strong vacuum through the nozzle.

16 Claims, 4 Drawing Sheets

CLEANING TOOL FOR REMOVING LINT FROM CLOTHES DRYERS

FIELD OF THE INVENTION

The present invention pertains to a cleaning tool for removing lint from a clothes dryer having a lint-screen cavity that houses a lint filter and, more particularly, to a flexible wand that is inserted into the lint-screen cavity of a clothes dryer in order to remove lint build-up within the inner confines of the dryer cabinet.

BACKGROUND OF THE INVENTION

Lint is produced in a clothes dryer by the tumbling action of the clothes dryer drum, which tends to abrade cloth during the drying process.

Manufacturers of clothes dryers have installed lint screens so as to catch the lint, in order to prevent it from clogging the inner mechanisms and exhaust ports of the dryer unit. The lint filters that are used in most clothes dryers are generally efficient in removing most of the lint produced during the tumbling action.

Despite such generally efficient filters, however, fine particles of lint often escape through and around lint screens. These errant particles of lint eventually build up to a point where they clog the inner mechanisms, particularly the exhaust tubing of the dryer machine. When this happens, the machine must work harder in order to force the heated air through the drying system. This, in turn, results in poor drying action and greater wear upon the moving parts of the drum.

In some cases, the lint accumulates to the extent that it completely clogs the dryer's flexible exhaust hose. When this happens, the heat from the exhaust gases becomes trapped by the lint material. When ignition temperature is reached, the lint begins to char and burn. Several fires are known to have been caused thus.

The cleaning of lint cavities in clothes dryers has heretofore been achieved by using a stiff brush and a vacuum wand. The brush is first employed to loosen the lint from the sides of the cabinet, and the vacuum wand thrust inside the lint cavity to evacuate the loosened lint materials.

There are several disadvantages to cleaning a lint cavity in this manner. The brushes and wands are stiff and cannot usually reach around corners and into inaccessible crevices. In addition, it is a two-step process, requiring that: (a) the walls of the cabinet first be scrubbed with the brush, and (b) the vacuum then applied to the loosened lint areas.

The present invention is a new cleaning tool that combines brushing and vacuum cleaning action into a single utensil, whereby the lint is vacuumed as it is simultaneously being loosened from the cabinet walls. The cleaning wand of this invention is flexible, so that it can more readily be manipulated around corners and into remote areas of the cabinet. The shape of the hollow wand is substantially flat, and thus it is highly flexible for working in narrow and remote areas. The nozzle of the wand has unique scraping surfaces that line the air-inlet windows, allowing lint to be simultaneously loosened and vacuumed away. Bristles can be added about these scraping surfaces to further enhance the cleaning action.

DISCUSSION OF RELATED ART

In U.S. Design Pat. No. Des 303,026 (issued to KILAKIS on Aug. 22, 1989, for a vacuum cleaner extension tool), a stiff wand is shown for reaching into recessed areas. The tool is stiff and inflexible, thus limiting its ability to reach around corners and into hidden crevices and grooves.

In U.S. Pat. No. 4,053,962 (issued to MC DOWELL on Oct. 18, 1977), a suction wand is illustrated. This vacuum tool is used to access hard-to-reach areas of household appliances, such as refrigerator cooling coils. The nozzle end of the tool is angled so as to increase the capability for creating suction within inaccessible areas. The angled end also provides a universality to the tool, so that it can be applied to many different appliances. In contrast thereto, the present invention is specifically designed for the elimination of accumulated lint in a clothes dryer. As such, the wand of Applicant's invention is specifically designed, as will be explained hereinafter.

SUMMARY OF THE INVENTION

In accordance with the present invention, there is provided a suction wand for use in cleaning lint from the lint-screen cavity of clothes dryers. This lint-catching tool is uniquely designed to provide a lint-loosening action in combination with a vacuum action. This dual action eliminates most of the drudgery associated with this particular task.

The tool itself comprises four snap-together portions. The first portion of the tool consists of a collar that attaches to the corrugated conduit or hose of a vacuuming device. The collar has a flared, rounded end that receives a substantially flat, rounded, hollow, flexible, elongated cleaning tube. The peripheral edges of the cleaning tube are designed to be rounded so as to provide for ease of bending, which is a necessary flexibility for accessing hard-to-reach areas within the clothes-dryer cabinet. The third portion of the wand consists of an intermediate collar that links the elongated cleaning tube with its unique scraping-and-suction nozzle.

This scraping-and-suction nozzle has novel inlet windows that are designed to capture the lint as the wand is thrust against lint-laden surfaces within the clothes cabinet. The inlet windows have scraping edges that form narrow inlets for the purpose of drawing strong vacuum through the nozzle. The inlet windows are also uniquely designed about the periphery of the scraping-and-suction end of the nozzle, as both of the sides and the front of the nozzle can draw lint into the suction wand. The side windows of the scraping-and-suction end of the nozzle are generally triangular-shaped, while the front windows are substantially rectangular-shaped. The nose of the nozzle itself is arcuate-shaped. This particular design allows the cleaning tool to cover a much larger cleaning area than its predecessors, which generally have narrow inlet nozzles.

It is an object of the present invention to provide an improved cleaning tool for removing lint accumulation in clothes dryers.

It is another object of this invention to provide a suction wand for cleaning lint from the cabinet of a clothes dryer, with the nozzle end thereof featuring dual-purpose suction-and-scraping surfaces so as to improve the efficiency of the cleaning operation.

It is a further object of the invention to provide a suction wand for cleaning lint from the cabinet of a clothes dryer, with the nozzle end thereof featuring both side- and front-inlet windows for enlarging the areas for suction and scraping that are reachable by the tool.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like components and elements of the invention will bear the same designations throughout the FIGURES.

DESCRIPTION OF THE PREFERRED EMBODIMENT

Generally speaking, the cleaning wand of this invention is designed specifically for removing lint from a lint-laden cabinet of a clothes dryer. The cleaning wand has a generally flat, flexible body portion, and a nozzle end portion having novel scraping and vacuuming inlet windows. The windows allow the walls of the cabinet to be simultaneously scraped and vacuumed in one motion. The windows are designed about the front and side peripheries of the nozzle end so as to clean an extended wall area.

Figure 1:
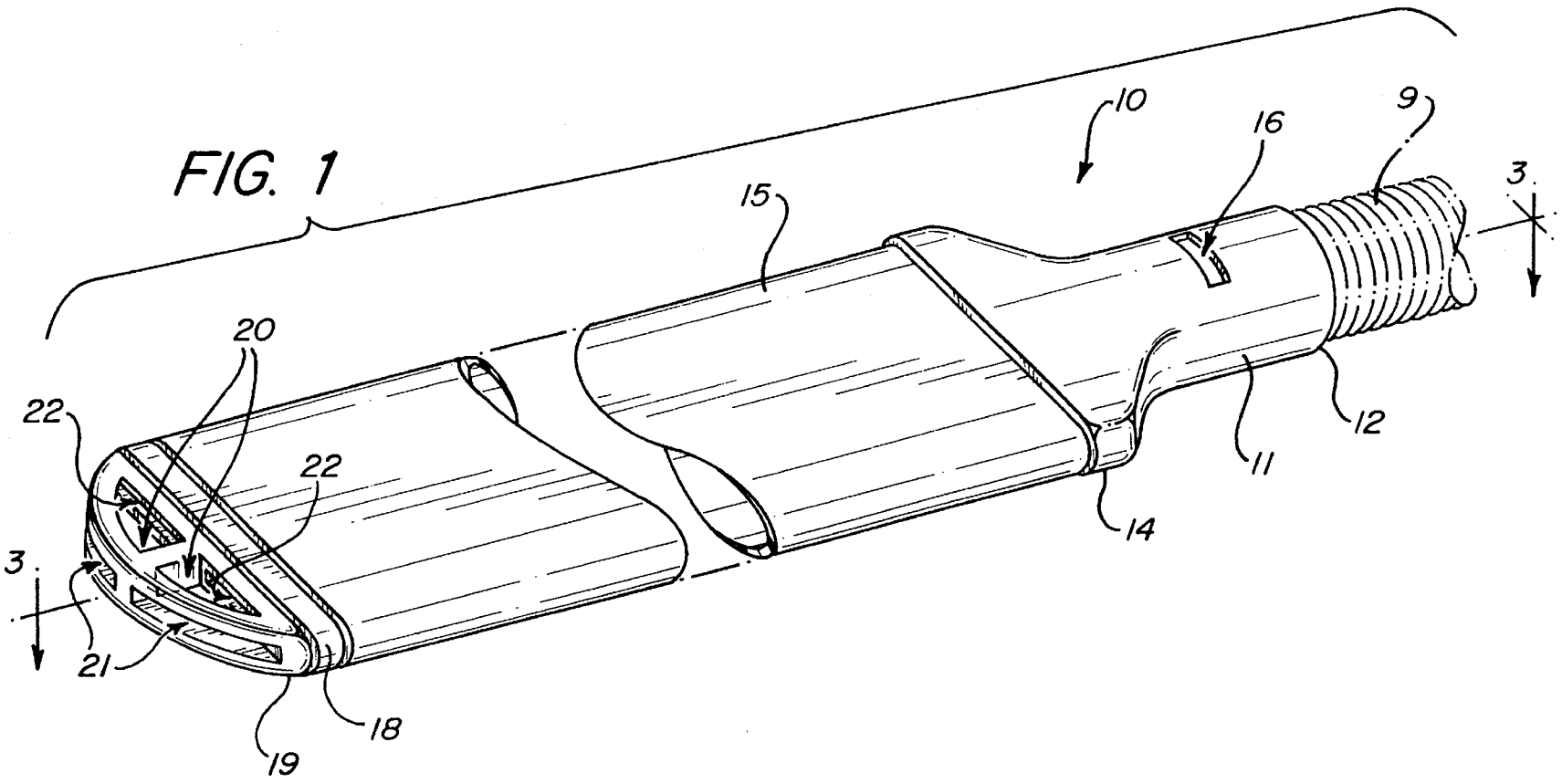
FIG. 1 illustrates a perspective view of the cleaning wand of this invention.
Figure 2:
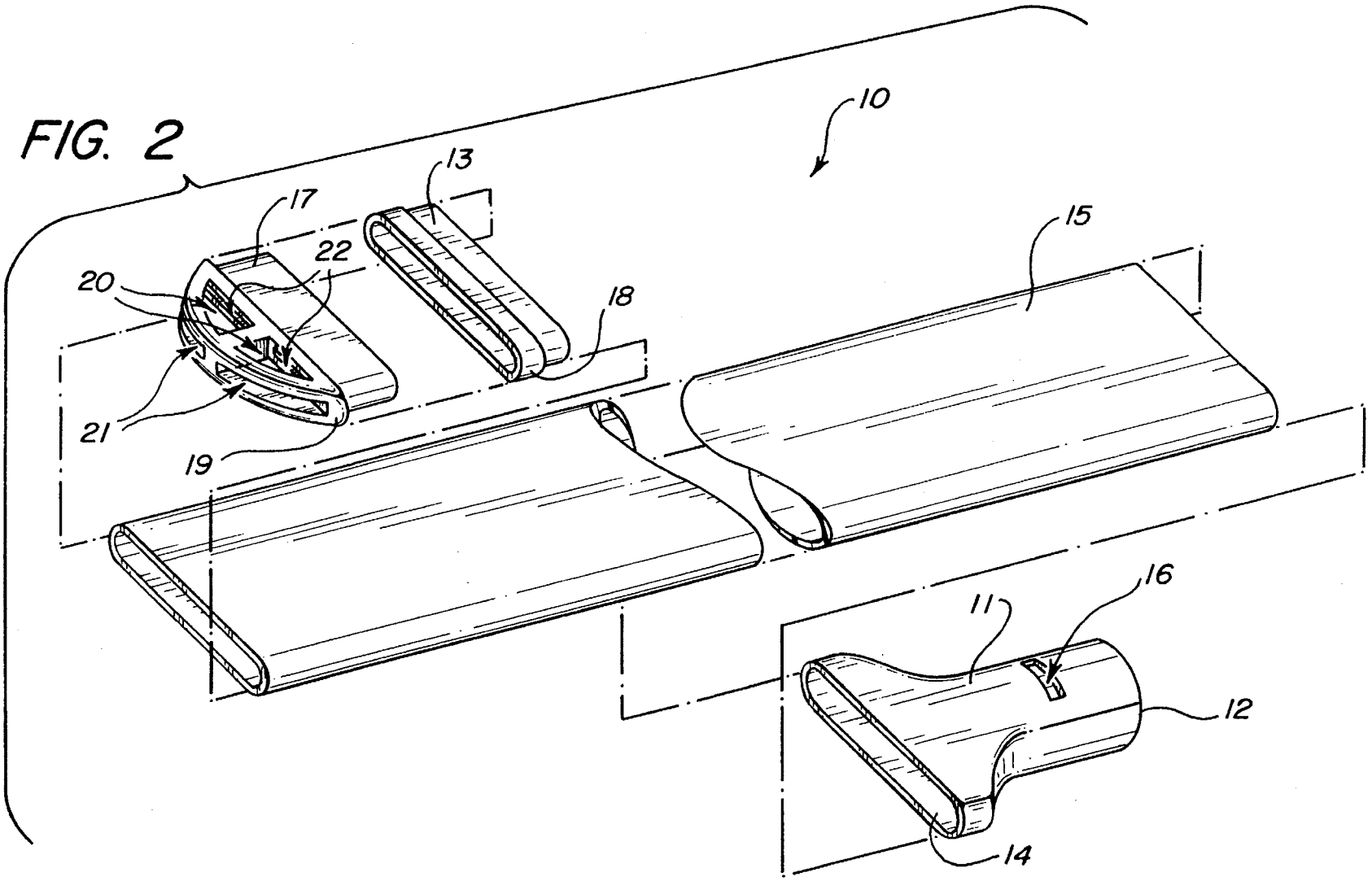
FIG. 2 depicts an exploded view of the cleaning wand shown in FIG. 1, featuring its four sections.
Figure 3:
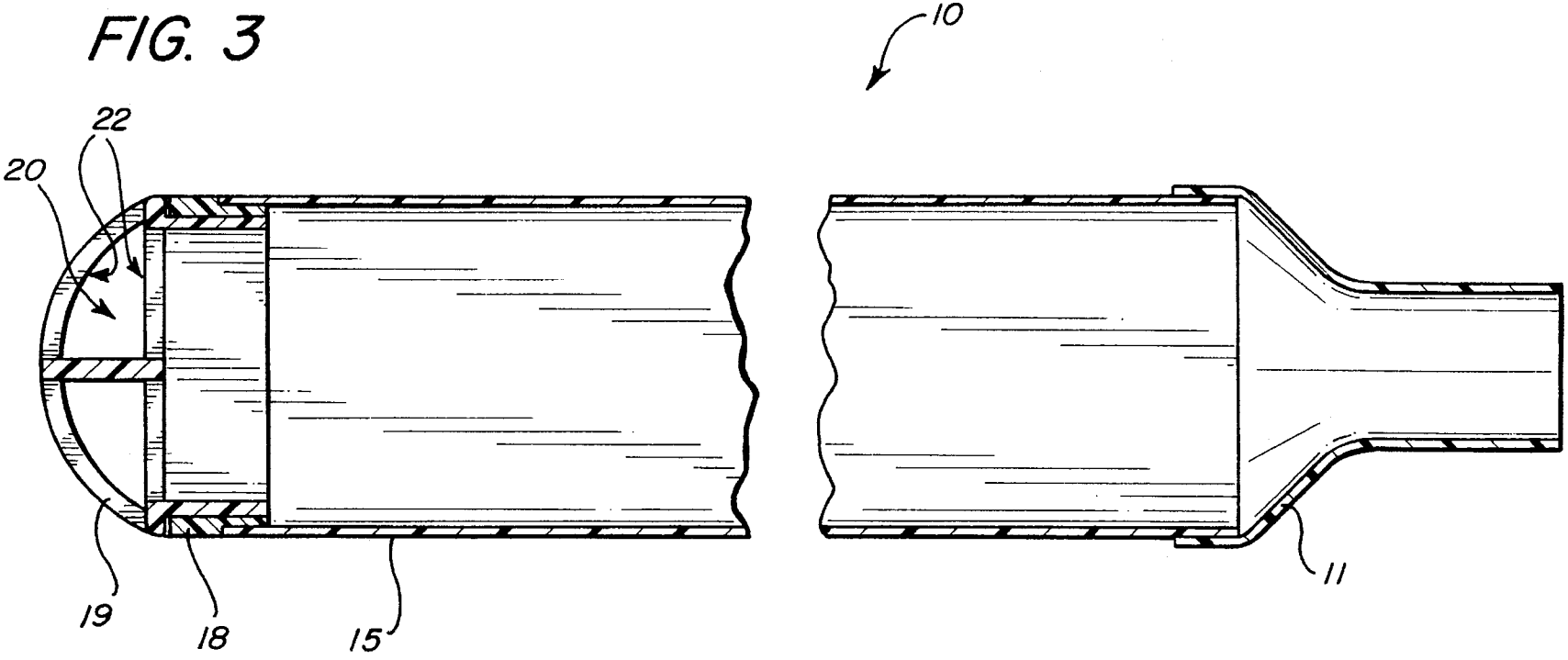
FIG. 3 shows a sectional view of the cleaning wand depicted in FIG. 1, taken along lines 3—3, thereof.

Now referring to FIGS. 1 through 3, the lint-cleaning wand 10 of this invention is illustrated. The wand 10 is designed to be attached to the corrugated hose 9 (FIG. 1) of a vacuum or suction-producing device (not shown). The cleaning wand 10 has a collar portion 11 that has a rounded, circular end 12 for attachment to the hose 9, and a flared end 14 for attachment to an elongated, generally flat, hollow, body portion 15, which attaches to the collar 11 at its rear distal end. The collar has a generally rectangular aperture 16 for drawing a vacuum through the wand 10 from the hose 9. The user of the wand 10 places his hand over the aperture 16, when he or she desires that the air flow through the wand. When the aperture 16 is left open, the air flow will be substantially diminished through the wand 10. In this manner, the aperture 16 operates as a convenient on-off switch.

The flexible, elongated, hollow body portion 15 of the wand 10 has a generally rectangular cross-section. Its rounded corners provide for its ability to flex about the longitudinal axis, running along lines 3—3. The forward distal end of the body portion 15 accommodates an intermediate collar 18, which is designed to link the body portion 15 with its cleaning nozzle 19. The cleaning nozzle 19 has novel scraping and vacuum side inlet windows 20, disposed on each side of the nozzle 19, and front scraping and vacuum inlet windows 21. The front section of the nozzle 19 is arcuate-shaped, so as to prevent scratching the surfaces of the cabinet. The body portion 15 is fabricated from a flexible plastic, such as polypropylene. The four sections 11, 15, 18 and 19 of wand 10 can be glued together to form one piece, or they may be designed to be detachable from each other for purposes of cleaning or replacing damaged or worn sections. The four respective sections 11, 15, 18 and 19 easily snap together, as shown.

The window surface edges 22 disposed about the peripheries of windows 20 are designed to be sharp and scraping. This sharpened edge facilitates the scraping removal of lint from cabinet wall surfaces, when the wand 10 is thrust back and forth against the walls.

Referring to FIG. 2, the nozzle and intermediate sections 19 and 18, respectively, have internal flange portions 17 and 13, respectively. The flange portions 17 and 13 allow these sections to be snapped into place with respect to body section 15.

Figure 4:
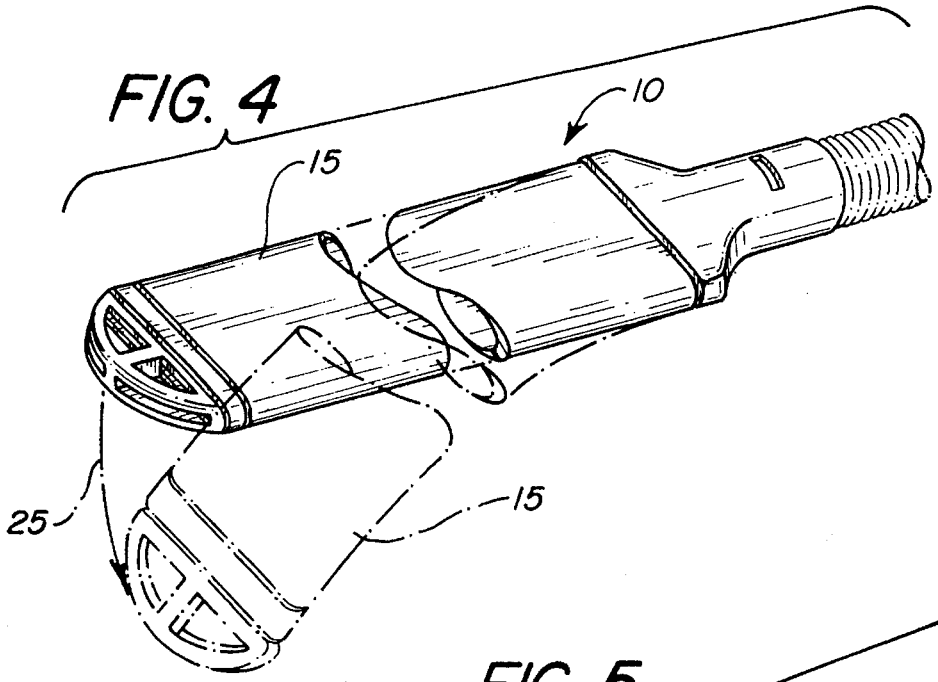
FIG. 4 illustrates a perspective view of the cleaning wand shown in FIG. 1, along with a phantom view depicting its flexibility.

Referring to FIG. 4, the body section 15 of the wand 10 is shown in a flexed, phantom view, as illustrated by arrow 25. The body section 15 bends about its longitudinal axis, as defined by lines 3—3 in FIG. 1.

Figure 5:
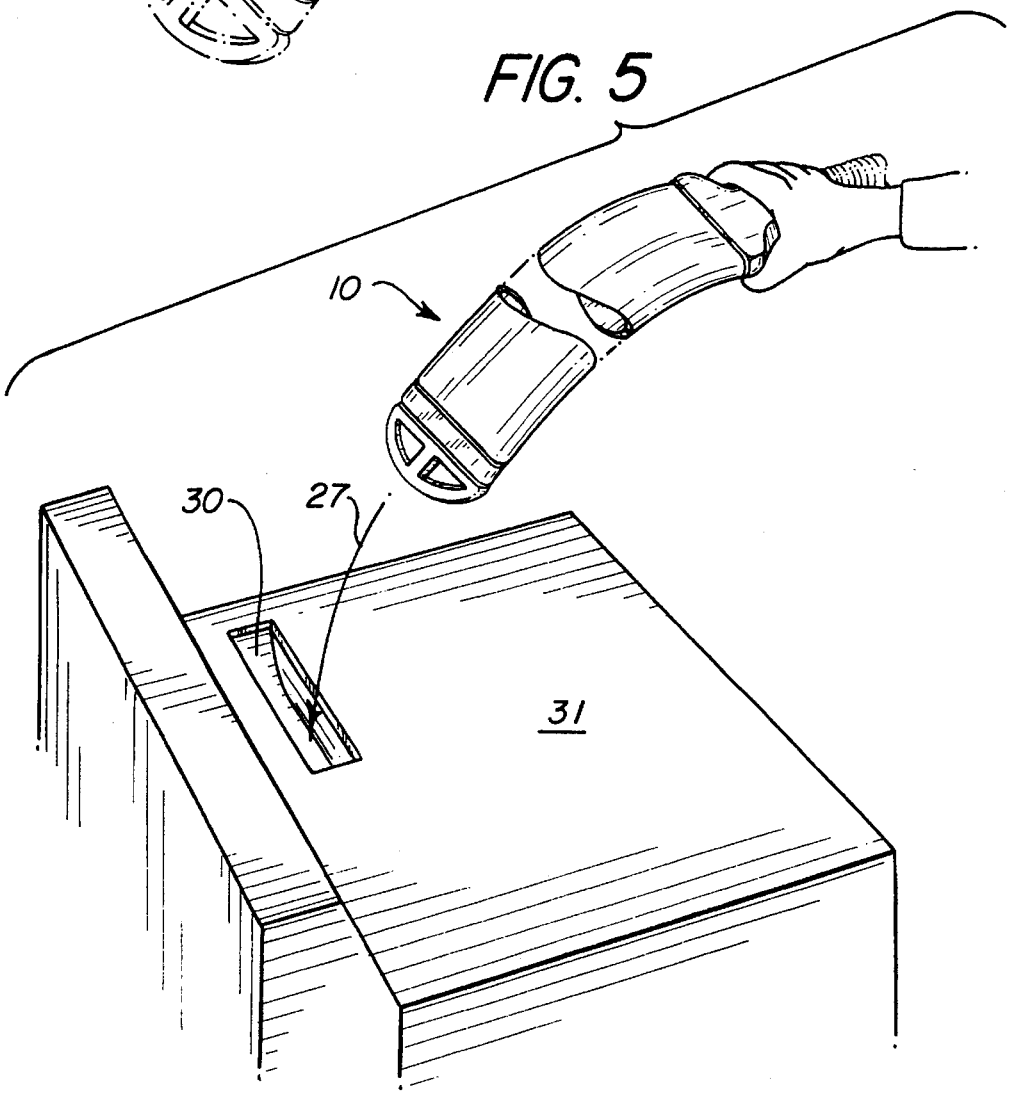
FIG. 5 depicts an in situ, perspective view of the cleaning wand shown in FIG. 1, as it is being thrust into the lint-filter cavity of a clothes dryer.

Referring to FIG. 5, the wand 10 is shown in an in situ view, in which the wand 10 is being thrust (arrow 27) into a cavity 30 of a typical clothes-dryer cabinet 31. The cavity 30 can be any accessible cavity provided by the manufacturer, but, in particular, the lint-screen cavity provided on most clothes-drying machines.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A cleaning wand for particular use in removing lint from a clothes-drying machine, comprising:

a collar attachment portion an intermediate portion;

an elongated, flexible, hollow, generally flat body portion having first and second distal ends, said body portion being attached to said collar at said first distal end and to said intermediate portion at said second distal end; and a nozzle portion attached to said intermediate portion, said nozzle portion having means defining inlet windows on side and front sections thereof, said inlet windows having scraping edges, whereby the lint may be loosened while a vacuum is being applied, thereby providing a dual-action scraping and vacuuming of lint-laden surfaces.

2. The cleaning wand in accordance with claim 1, wherein said collar, said intermediate portion, said body portion and said nozzle portion respectively snap together for ease of assembly.

3. The cleaning wand in accordance with claim 1, wherein said collar has a flared end for attachment to said first distal end of said body portion.

4. The cleaning wand in accordance with claim 1, wherein said body portion has a rounded cross-section to provide flexibility.

5. The cleaning wand in accordance with claim 1, wherein said nozzle portion is arcuate-shaped.

6. The cleaning wand in accordance with claim 1, wherein said collar, said intermediate portion, said body portion and said nozzle portion are respectively bonded together.

7. The cleaning wand in accordance with claim 1, wherein said collar has means defining an aperture, said aperture acting as an on-off switch for applying a vacuum force for said wand.

8. A cleaning wand for attachment to a vacuum producing machine, comprising:

a collar attachment portion an intermediate portion;

an elongated, flexible, hollow, generally flat body portion having first and second distal ends, said body portion being attached to said collar at said first distal end and to said intermediate portion at said second distal end; and a nozzle portion attached to said intermediate portion, said nozzle portion having means defining inlet windows on side and front sections thereof, said inlet windows providing a dual-action scraping and vacuuming of surfaces.

9. The cleaning wand in accordance with claim 8, wherein said collar, said intermediate portion, said body portion and said nozzle portion respectively snap together for ease of assembly.

10. The cleaning wand in accordance with claim 8, wherein said collar has a flared end for attachment to said first distal end of said body portion.

11. The cleaning wand in accordance with claim 8, wherein said body portion has a rounded cross-section to provide flexibility.

12. The cleaning wand in accordance with claim 8, wherein said nozzle portion is arcuate-shaped.

13. The cleaning wand in accordance with claim 8, wherein said collar, said intermediate portion, said body portion and said nozzle portion are respectively bonded together.

14. The cleaning wand in accordance with claim 8, wherein said collar has means defining an aperture, said aperture acting as an on-off switch for applying a vacuum force for said wand.

15. The cleaning wand in accordance with claim 8, wherein said side inlet windows of said nozzle portion are substantially triangular-shaped.

16. The cleaning wand in accordance with claim 8, wherein said front inlet windows of said nozzle portion are substantially rectangular-shaped.

* * * * *